United States Patent [19]

Layman et al.

[11] 4,128,071

[45] Dec. 5, 1978

[54] UNDERWATER MINE CHAIN/CABLE CUTTER

[75] Inventors: Bobby C. Layman; Lanny G. Burdge, both of Dahlgren, Va.

[73] Assignee: The United States of America as represented by the Secretary of the Navy, Washington, D.C.

[21] Appl. No.: 327,150

[22] Filed: Nov. 29, 1963

[51] Int. Cl.[2] ..... B63B 43/00; B63C 7/16; B63C 11/50; B26D 1/00

[52] U.S. Cl. ..... 114/221 A; 89/1 B

[58] Field of Search ..... 114/221.1, 221 A; 89/1.01, 1 B

[56] References Cited

U.S. PATENT DOCUMENTS

| | | | |
|---|---|---|---|
| 2,920,532 | 1/1960 | McBride | 114/221.1 |
| 3,020,871 | 2/1962 | Temple et al. | 114/221.1 |

*Primary Examiner*—Samuel W. Engle
*Assistant Examiner*—Thomas H. Webb

EXEMPLARY CLAIM

1. In an improved paravane the combination comprising;
   - a body unit,
   - a charge housing,
   - means for slideably engaging said charge housing with said body unit,
   - a mooring line engaging means pivotally connected to and extending from said charge housing,
   - an explosive charge disposed in said charge housing,
   - a detonation means attached to said body unit and connected to said explosive charge for actuating said explosive charge upon a predetermined amount of relative movement between said charge housing and said body unit, and
   - a locking means disposed in said charge housing between said mooring line engaging means and said detonation means for preventing relative movement between said charge housing and said body unit prior to movement of said mooring line engaging means.

15 Claims, 8 Drawing Figures

INVENTORS
Bobby C. Layman
Lanny G. Burdge

BY Claude Funkhouser
ATTORNEY

IN WATER ARMED

OUT OF WATER SAFE

UNDERWATER MINE CHAIN/CABLE CUTTER

The invention described herein may be manufactured and used by or for the Government of the United States of America for governmental purposes without the payment of any royalties thereon or therefor.

The present invention relates generally to an improved paravane. More particularly, the invention relates to a new and improved paravane capable of mine sweeping operations in which chain and cable mooring lines are severed.

Paravanes are devices which are attached to cables and pulled through a body of water to contact mooring lines and sever them. The most common use of paravanes is in mine sweeping operations where a long towing cable, which has a series of paravanes attached to it at various points, is attached to a towing vehicle, such as a ship or helicopter, and pulled through the water. As the towing cable is pulled through the water, it will cross the mooring line of a mine in its path of travel and will ride upon the mooring line until the paravane comes in contact with the mooring line. Upon contact with the mooring line, the paravane will be actuated and will sever the mooring line. As the paravane or cutter is towed through the water, it is hydrodynamically stabilized by a fin so that the forward end of the cutter will always face in the direction of the movement of the towing cable to which it is attached and which is being dragged through the water.

In a normal mine sweeping operation, 50 to 100 cutters are employed in a single sweep. The weight of these cutters, therefore, is of primary importance, especially when the paravanes are towed by a helicopter. Such cutters must be designed with simplicity and minimum weight.

The paravanes that are presently being used have performed satisfactorily in many types of mine sweeping operations. There are, however, certain capabilities which the prior art paravanes have been unable to provide. The paravane used in a mine sweeping operation must be one having a feature which will allow the mechanism of the paravane, which traps the chain or cable mooring line, to be detached from the paravane body in the event that the actuating mechanism of the paravane does not actuate to sever the mooring line. This feature is necessary because in the event the mechanism which actuates to sever the mooring line does not operate, the paravane will drag the mooring line. In other words, without such a feature, an entanglement will occur which seriously hampers the entire mine sweeping operation and often the cable, to which a non-actuated paravane is attached and which is towing a string of paravanes, must be released from the towing vehicle. The present invention encompasses such a unique feature which allows the paravane to detach itself from the mooring line in the event the mooring line severing mechanism does not operate as well as after a successful actuation of the paravane.

In addition, the paravanes known in the prior art utilize a chisel type cutting concept. That is to say, when the prior art paravanes engage the mooring line they are actuated to discharge a cutting edge against the mooring line to thereby sever the mooring line. The prior art also discloses the utilization of conically configured shaped charges to create point cuts of mooring lines. It has been determined, however, that a more efficient cutting or severing capability is accomplished by utilizing an explosive cartridge containing a linear shaped charge to create a line of intense energy to sever the mooring line. The present invention utilizes such a linear shaped charge to sever a mooring line.

It is, therefore, the general purpose of this invention to provide an improved paravane which embraces all of the advantages of the similarly employed prior art devices and which has advantages and capabilities not available in the prior art devices. To attain the desired performance, the present invention contemplates a unique and novel arrangement of components and elements so as to provide an improved paravane which is capable of being utilized in large scale mine sweeping operations.

Accordingly, it is an object of the present invention to provide a novel combination of components which comprise a paravane capable of cutting mooring lines of a size herebefore not severable by paravanes.

Another object of the present invention is to provide a paravane having a breakaway feature whereby the mooring line engaging mechanism of the paravane is disengaged from the tow line upon engagement with a mooring line regardless of whether or not the paravane actuates.

A further object of the present invention is to provide a paravane which is of light weight, simple construction, and inexpensive to manufacture.

Still another object of the present invention is to provide a paravane having a safety feature which allows the device to be actuated only in water.

A still further object of the present invention is to provide a paravane which utilizes a linearly shaped explosive charge to create a line of intense heat and explosive energy which is utilized to sever a mooring line.

Other objects and many of the attendant advantages of this invention will be readily appreciated as the same becomes better understood by reference to the following detailed description when considered in connection with the accompanying drawings wherein.

Figure 3:
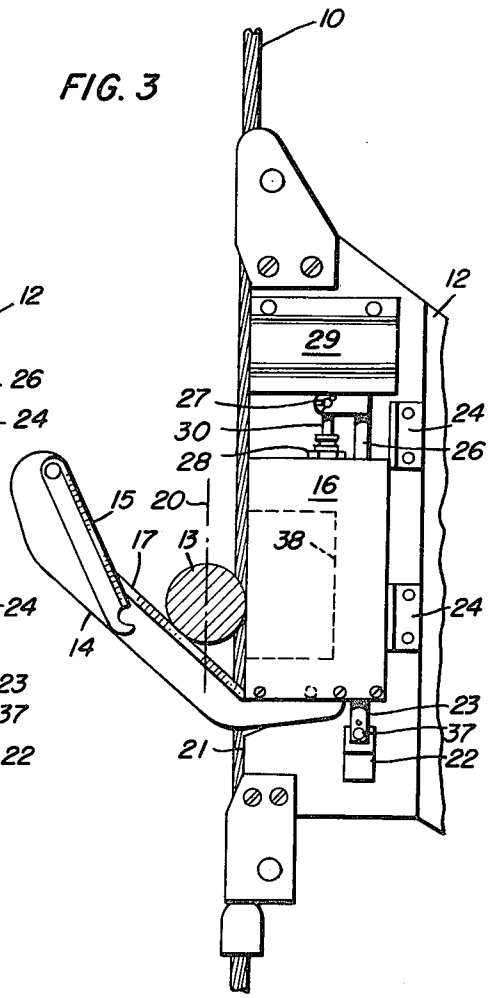
FIG. 3 is a side elevational view of the paravane of FIG. 1 shown as the mooring line is being severed.
Figure 2:
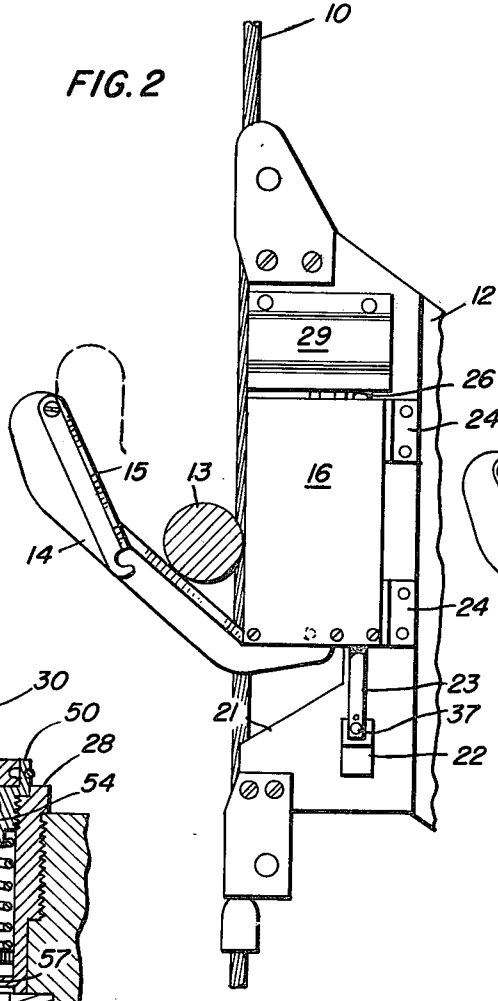
FIG. 2 is a side elevational view of the paravane of FIG. 1 shown as having contacted a mooring line.
Figure 1:
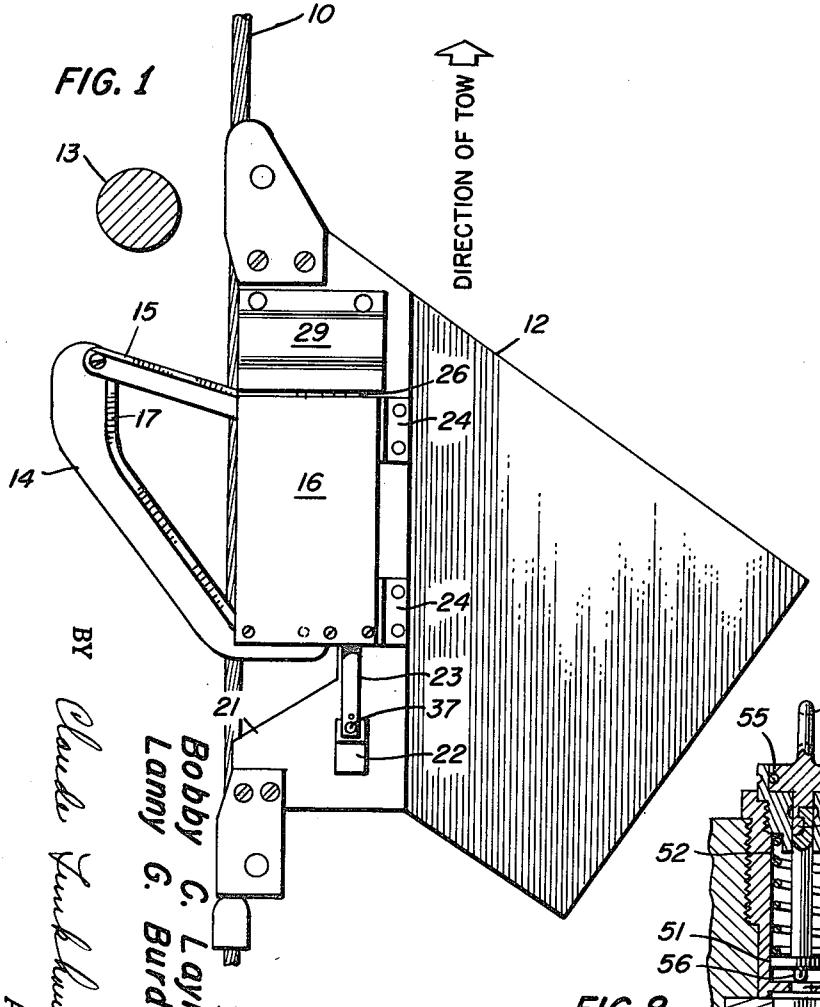
FIG. 1 is a side elevational view of a paravane embodying the features of the present invention.

Referring now to the drawings, wherein like reference characters designate like or corresponding parts throughout the several views, there is shown in FIG. 1 a paravane as it is towed through the water by a cable 10 which leads to another like paravane or a weight. The paravane utilizes a fin 12 to hydrodynamically stabilize the movement of the paravane through the water. A mine mooring line is shown in cross-section at 13. The mooring line 13 as shown in FIG. 1 is at a distance from the towing cable 10, but in most instances the towing cable 10 will contact the mooring line 13 and as the paravane is towed through the water the mooring line 13 will move along the towing cable 10 until it comes into contact with the trip bar 15. As is shown in FIG. 2, the mooring cable 13 has disengaged the trip bar 15 to allow the cutting trigger 14 to pivot thereby to actuate the explosive charge carried by the charge housing 16. FIG. 3 shows the paravane components as the explosion creates a line 20 of intense heat and explosive energy to sever the mooring cable 13. The cutting edge 17 also aids the severing of the mooring cable 13 as the explosion urges the cable 13 against it.

Figure 5:
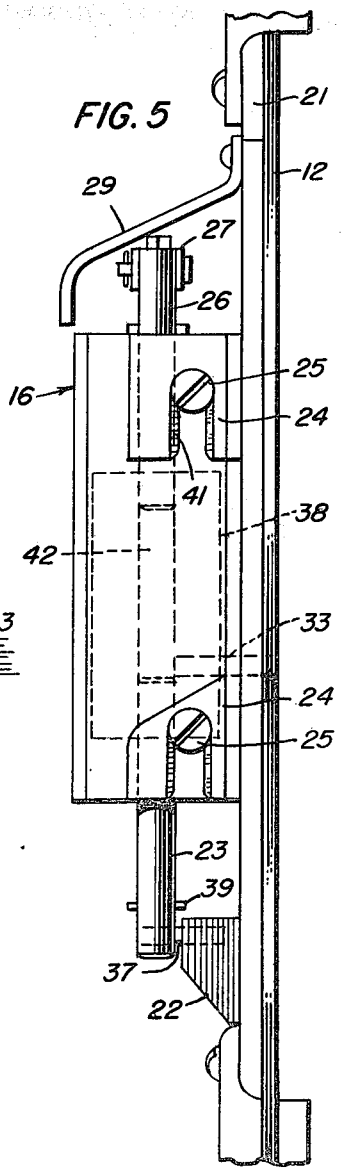
FIG. 5 is a vertical end view of the paravane of FIG. 4.
Figure 4:
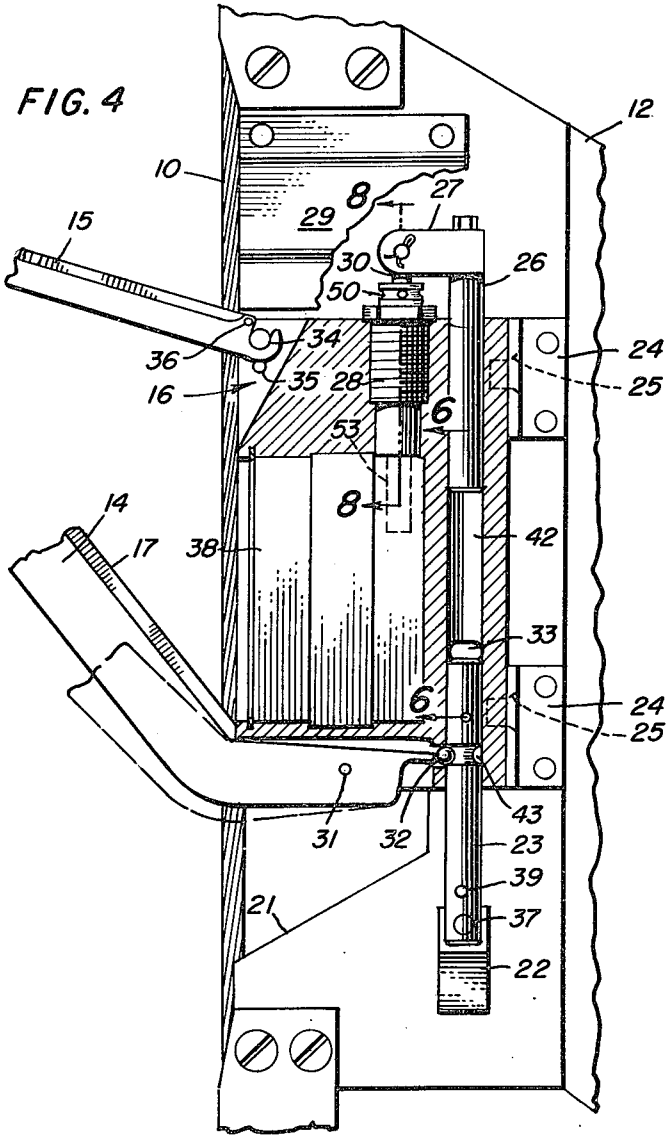
FIG. 4 is a longitudinal sectional view of a paravane embodying the features of the present invention.

The relationship of the components comprising the paravane is more clearly shown by FIGS. 4 and 5. In FIGS. 4 and 5 there is shown a paravane which has a slider bar or body member 21. Attached to the slider bar or body member 21 are slider groove members 24 which are right-angle members having grooves 41 for receiving flared head bolts 25. A charge housing 16 is attached to the slider bar 21 by bolts 25 which slide into the grooves 41 in the slider groove elements 24. The charge housing 16 may be removed from the slider bar by sliding the charge housing downwardly with respect to the slider bar 21 to disengage the bolts 25 from the grooves 41 of the slider groove elements 24. The charge housing 16 has a bore 42 extending longitudinally therethrough. A cantilever member 22 is supported by the slider bar 21 beneath the charge housing 16. The cantilever member 22 supports a plunger 23 through a pin 37. The plunger 23 extends upwardly into the bore 42. A bar 39 extends through the plunger 23 to limit the movement of the charge housing 16 downwardly on the plunger. A passage 33 connects the bore 42 with the environmental surroundings of the paravane. The plunger 23 has a groove 43 in which rides a ball 32. The ball 32 prevents relative motion between the plunger 23 and the charge housing 16 when the ball 32 is held in the groove by the cutting trigger 14.

A cutting trigger 14, which has a cutting edge 17, is pivotally mounted by pin 31 on the charge housing 16. One end of the cutting trigger 14 retains ball 32 in the groove 43. The trip bar 15, as is more clearly shown in FIGS. 1 through 3, is pivotally connected to the cutting trigger 14 and is secured to the charge housing 16 by a retaining pin 34 and a shear pin 36. A safety pin 35 holds the trip bar 15 in place on the retaining pin 34 when the paravane is in storage.

Figure 8:
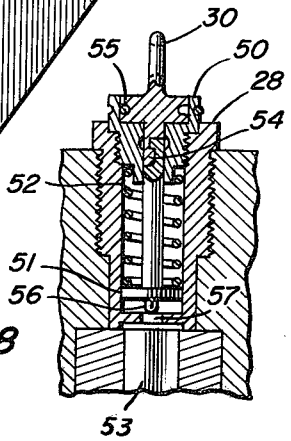
FIG. 8 is a fragmentary sectional view taken along line 8—8 of FIG. 4 showing the details of the igniter.

The detonating mechanism is more clearly shown in FIG. 4. Disposed in the upper end of the bore 42 is a piston 26 which is connected by a link 27 and a rod or pull pin 30 to igniter mechanism 28. The charge housing 16 has a cavity for containing a shaped explosive charge 38. An illustratve igniter 28, which is more clearly shown in FIG. 8, detonates the explosive charge 38 when the piston 26 is moved upward with respect to the charge housing 16. The igniter employs a guide plug 50 which is threaded into the ignitor body 28. A firing pin 51 is slidably disposed within the ignitor body 28. A spring 52 is disposed between the guide plug 50 and the head of the firing pin 51 to urge the firing pin toward the initiator charge 53. A pull pin 30 is slidably disposed in the guide plug 50 and interlocks at the connection 54 with the firing pin 51. Upon removal of the safety pin 55 the pull pin 30 may be retracted from the guide plug 50 whereupon the pull pin will disengage from the firing pin 51 at the connection 54 to allow the spring 52 to propell the firing pin 51 so that the protrusion 56 of the firing pin will strike the initiator charge 53 through the aperture 57. The initiator charge 53 in turn ignites the linearly shaped charge 38. Attached to the slider bar 21 is a protective member 29 to cover the piston 26, link 27, and pull pin 30 to prevent any foreign articles from becoming entangled in the ignitor mechanism.

In operation, the paravane is attached to a tow cable 10 which is pulled through the water by a helicopter, ship or any other towing vehicle. Should the tow cable 10 encounter a chain or cable mine mooring line, the cable 10 will move across the mooring line until the paravane comes in contact with the mooring line. When such contact is made, the mooring line rests upon the trip bar 15 until the mooring line transmits a predetermined amount of force against the trip bar 15 whereupon the shear pin 36 is sheared. Upon shearing of the pin 36, the trip bar 15 disengages itself from the charge housing 16. Once the trip bar 15 is disengaged from the charge housing the cutting trigger 14 is free to pivot about the pin 31 and will so pivot due to the force exerted on the cutting edge 17 by the mooring line. When the cutting trigger 14 has pivoted the ball 32 will fall from the groove 43. The force exerted on the cutting trigger 14 by the mooring line then forces the charge housing 16 downward so that the bolts 25 move along the grooves 41. As the paravane is towed in water, the bore 42 between the plunger 23 and the piston 26 is filled with water through the passage 33. As the charge housing moves downward, due to the force of the mooring line against the cutting trigger 14, the plunger 23 covers the passage 33 to entrap a column of water between the piston 26 and the plunger 23. The water entrapped between the plunger 23 and the piston 26 transmits the force applied to the cutting trigger 14 by the mooring line from plunger 23 to the piston 26. The piston 26, therefore, is forced out of the bore 42 to cause a rod or pull pin 30 to be moved a predetermined amount to detonate the igniter assembly 28 which in turn, through the initiator charge 53, ignites the shaped explosive charge 38. The ignition of the shaped explosive charge 38 severs the mooring line by creating a line of intense heat energy aided somewhat by forcing the mooring cable against the cutting edge 17.

In the event that the detonator system or explosive charge fails to detonate, or after completion of an actuation, the charge housing 16 moves downwardly until the bolts 25 are free of the grooves 41 whereby the charge housing is free from the slider bar or body member 21. Once the charge housing 16 is free of the slider bar 21 it pivots about the pin 37 as the plunger 23 remains in the bore 42. The charge housing 16 pivots until the force of the mooring line or the drag forces created by the towing of the paravane through the water pulls the charge housing with the cutting trigger 14 from the plunger 23. Once this occurs only the slider bar 21 and the plunger 23 remain attached to the towing cable 10. Detachment of the charge housing 16 from the towing cable after actuation of the explosive charge enables subsequent mooring lines to pass the actuated paravane assembly without interference. The detachment of the charge housing 16 from the towing cable upon the occurrence of a malfunction of the mooring line severing mechanism will prevent the dragging of a mooring line and enables the paravane to be utilized again by attaching another charge housing assembly.

Figure 6:
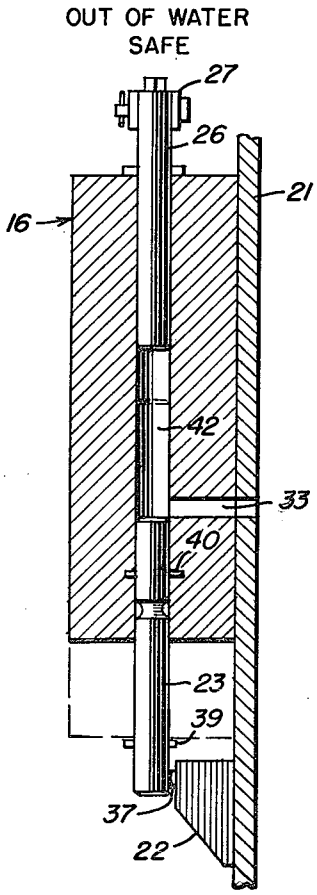
FIG. 6 is a fragmentary sectional view taken along line 6—6 of FIG. 4.

FIG. 6 shows the plunger and piston assembly when the paravane is surrounded by atmospheric air pressure and, therefore, the vent passage 33 is open to the compressible gases of the atmosphere. The explosive actuating mechanism is prevented from being actuated when the paravane is disposed in a gaseous environment such as the atmosphere. The bar 39 prevents the plunger 23 from contacting the piston 26 upon the inadvertent movement of the charge housing 16 downward with respect to the slider bar 21 and any air entrapped between the plunger 23 and the piston 26 will be compressed and, therefore, will not transmit sufficient force to the piston 26 to move it from the bore 42. Also provided is a shear pin 40 to prevent relative movement between the plunger 23 and the charge housing 16. The bar 39 also allows the charge housing 16 and plunger 23 to freely pivot about the pin 37.

Figure 7:
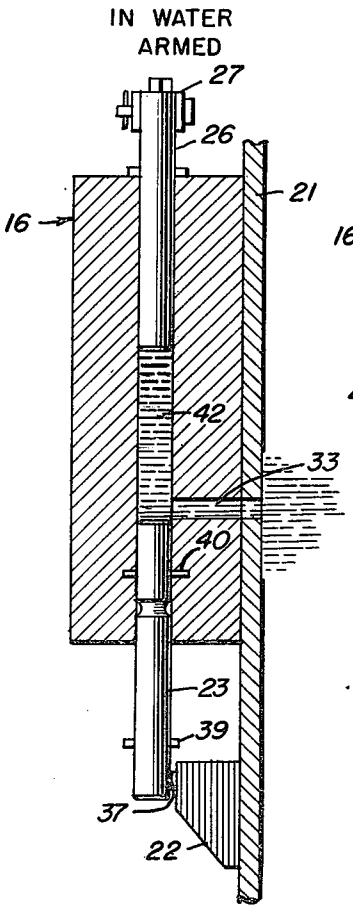
FIG. 7 is a fragmentary sectional view taken along line 6—6 of FIG. 4 but showing the mechanism in an air environment.

FIG. 7 shows the plunger 23 and piston 26 as the paravane is disposed in water. The bore 42 is is filled with water so that when the charge housing 16 moves downwardly the passage 33 is covered by the plunger 23 to entrap a column of water between the plunger 23 and the piston 26. The entrapped column of water is noncompressible and therefore the piston 26 is forced out of the bore 42.

As is apparent from the foregoing description, the present invention provides a unique paravane which is of a simple design, is light in weight, utilizes the concept of creating a line of intense heat and explosive energy from a linearly shaped charge to sever a mooring cable, and is releasable from the mooring line upon actuation or malfunction of the explosive charge igniting system.

The invention has been described in an illustrative manner and it is to be understood that the terminology which has been used herein is intended to be in the nature of words of description rather than of limitation.

Obviously many modifications and variations of the present invention are possible in the light of the above teachings. It is therefore to be understood that within the scope of the appended claims the invention may be practicied otherwise than as specifically described.

What is claimed is:

1. In an improved paravane the combination comprising;

a body unit, a charge housing, means for slideably engaging said charge housing with said body unit, a mooring line engaging means pivotally connected to and extending from said charge housing, an explosive charge disposed in said charge housing, a detonation means attached to said body unit and connected to said explosive charge for actuating said explosive charge upon a predetermined amount of relative movement between said charge housing and said body unit, and a locking means disposed in said charge housing between said mooring line engaging means and said detonation means for preventing relative movement between said charge housing and said body unit prior to movement of said mooring line engaging means.

2. In a paravane as described in claim 1 wherein;

a safety means is incorporated in said detonation means for preventing the actuation of said explosive charge when said paravane is surrounded by a gaseous environment.

3. An improved paravane for severing a mooring line comprising;

a slider bar member, a charge housing slideably supported by said slider bar member, a cutting trigger pivotally mounted on said charge housing and extending away from and in the direction of intended movement of the paravane, a tripping means disposed between a first end of said cutting trigger and said charge housing for preventing pivotal movement of said cutting trigger, an explosive charge disposed within said charge housing, a detonation means operably connected to said slider bar member for sliding movement within said charge housing to detonate said explosive charge, a locking means between a second end of said cutting trigger and said detonation means for preventing relative movement between said charge housing and said detonation means when said tripping means is in place whereby as said paravane is pulled through the water a mooring line will contact and move said tripping means and rest upon said cutting trigger to pivot same thereby to disengage said locking means to allow said charge housing to slide along said detonation means to detonate said explosive charge whereby the mooring line is forced against the cutter trigger and is severed by the intense heat and explosive energy of the explosive charge.

4. An improved paravane as set forth in claim 3 and further defined as including;

a shear pin disposed in said charge housing adjacent said tripping means for securing said tripping means to said charge housing prior to the application of a predetermined force to said tripping means.

5. An improved paravane as set forth in claim 3 and further defined as including;

a shear pin interconnecting said charge housing and said detonation means whereby relative motion between said charge housing and said detonation means is prevented prior to the application of a predetermined force to said cutting trigger.

6. An improved paravane comprising;

an elongated slider bar, a charge housing slideably supported in a longitudinal direction by said slider bar, a cutting trigger having inner and outer end portions and pivotally mounted at its inner end portion on one end of said charge housing and extending away from said charge housing to its outer end, a movable trip means disposed between said outer end of said cutting trigger and said charge housing for preventing pivotal movement of said cutting trigger, said charge housing having an open cavity facing said cutting trigger, an explosive charge disposed within said cavity, detonation means slideably disposed within said charge housing in juxtaposition to the inner end of said cutting trigger and supported by said slider bar for actuating said explosive charge, and locking means disposed between said inner end of said cutting trigger and said detonation means for preventing relative movement between said detonation means and said charge housing when said trip means is in place between said charge housing and said outer end of said cutting trigger.

7. An improved paravane as set forth in claim 6 wherein said detonation means comprises;

a plunger pivotally supported from said slider bar and slideably disposed in a bore in said charge housing, a piston disposed in said bore at a predetermined distance from said plunger, an igniter disposed in said charge housing in juxtaposition to said explosive charge, link-rod means connecting said piston with said igniter for actuating said igniter upon a predetermined amount of movement of said piston in said bore, a fluid passage disposed in said charge housing to provide fluid communication between said bore and the environmental surroundings of said paravane, and a shear pin interconnecting said plunger and said charge housing to prevent relative movement between said plunger and said charge housing prior to the application of a predetermined force to said cutting trigger.

8. An improved paravane for use in severing a mooring line in an underwater environment comprising;

a slider bar, a fin attached to said slider bar, slider groove means supported by and extending from said slider bar, a charge housing, groove mating means on said charge housing for engagement with said slider groove means to slideably attach said charge housing to said slider bar, said charge housing having a bore extending therethrough in a direction parallel to said slider groove means, a plunger pivotally supported by and parallel to said slider bar and slideably disposed in said bore in said charge housing, a cutting trigger pivotally mounted on the one end of said charge housing and extending diagonally away from said charge housing to an outer end, a trip bar pivotally connected to said outer end of said cutting trigger and connected to said charge housing, a trip bar retaining pin for securing said trip bar to said charge housing, said charge housing having a cavity facing said cutting trigger, a linearly shaped explosive charge disposed within said cavity, an ignition means disposed in said charge housing in juxtaposition to said explosive charge for igniting said explosive charge, a piston disposed in said bore and connected to said ignition means, a locking means disposed between said cutting trigger and said plunger for preventing relative movement between said charge housing and said slider bar when said cutting trigger is secured by said trip bar, and said charge housing having a fluid passage connecting the exterior of said charge housing with said bore between said plunger and said piston whereby as said paravane is pulled through the water and a mooring line strikes and disengages said trip bar from said charge housing and the mooring line then rests upon said cutting trigger to pivot said cutting trigger and disengage said locking means to allow said charge housing to move along said plunger and cause said plunger to cover said passage and trap water between said plunger and said piston to move said piston and detonate said explosive charge to propel said mooring line against said cutting trigger and to sever the mooring line due to an intense line of heat and explosive energy created by the charge and whereby upon the malfunction of said explosive charge said groove mating means will disengage from said slider groove means and said charge housing will rotate about the pivot of said plunger and subsequently slide from said plunger thereby disconnecting said charge housing from said slider bar.

9. An improved paravane as set forth in claim 8 and further defined as including;

a first shear pin disposed in said charge housing adjacent said trip bar to hold said trip bar on said retaining pin prior to the application of a predetermined force to said trip bar, and a second shear pin disposed in said charge housing and extending through said plunger to prevent relative movement between said charge housing and said plunger prior to the application of a predetermined force to said cutting trigger.

10. An improved paravane as set forth in claim 8 wherein said ignition means comprises;

an initiator charge, a firing pin, a biasing means for urging said firing pin toward said initiator charge, a trip means for moving said firing pin against said biasing means and for preventing contact with said initiator charge by said firing pin, and a release means for releasing said firing pin from said trip means upon a predetermined movement of the trip means and firing pin away from said initiator charge whereby said firing pin is propelled against said initiator charge by said biasing means to ignite said initiator charge thereby to detonate said explosive charge.

11. A paravane comprising;

a body member, an explosive charge housing, an explosive charge means disposed in said charge housing, connection means interconnecting said body member with said explosive charge housing for disengaging said charge housing from said body member upon a predetermined amount of relative movement therebetween, a cutting means attached to and extending from said charge housing, said charge means disposed so as to detonate toward said cutting means, and detonation means for actuating said explosive charge means upon a predetermined amount of movement between said charge housing and said body member.

12. The relationship of components as set forth in claim 11 and further defined as including;

a safety means associated with said detonation means for allowing detonation of said explosive charge means only when said paravane is disposed in a liquid environment.

13. An improved paravane for severing cable and chain in an underwater environment comprising;

a slider bar member, flat members extending from and attached to said slider bar member, said flat members having slots closed at one end thereof, a charge housing, studs extending from said charge housing for engagement with said slots to secure said charge housing in sliding relationship with said slider bar member, said charge housing having a bore parallel to said slots and extending through said charge housing, a plunger support member extending from and attached to said slider bar member, a plunger support pin secured in said plunger support member, a plunger slideably disposed in said bore and pivotally connected to said plunger support pin, a shaped explosive charge disposed within said charge housing, an igniter disposed in said charge housing adjacent said explosive charge, a rod extending from said igniter for actuating said igniter upon being pulled from said igniter whereby said explosive charge is detonated, a piston disposed in said bore at a predetermined distance from said plunger, a link connecting said piston and said rod whereby said rod is moved when said piston is moved within said bore, said charge housing having a fluid passage connecting the portion of said bore betwen the piston and the plunger with the exterior of said charge housing, said passage being disposed so as to intersect said bore in juxtaposition to said plunger when said studs are at the closed end of said slots in said flat members, an elongated cutting element pivotally connected in juxtaposition to one end thereof to said charge housing, said cutting element extending in a direction diagonally away from said charge housing whereby an open trap is formed by said charge housing and said cutting element, a trip bar pivotally connected to the other end of said cutting element and secured to said charge housing, a shear pin attached to said charge housing to secure said trip bar thereto, said plunger having a groove therein, said charge housing having an opening adjacent said groove, and a ball disposed in said opening and retained in said groove by said one end of said cutting element thereby to prevent relative movement between said charge housing and said plunger, said shear pin being constructed to shear when the trip bar is contacted with sufficient force by a mooring line to free said trip bar and permit the mooring line to strike said cutting element to pivot said cutting element and allow said ball to escape from said groove allowing said charge housing to move with respect to said slider bar member and cause said plunger to cover said passage thereby to trap a column of water which transmits force to said piston to move said piston and said rod by said link and detonate said explosive charge to force the mooring line against said cutting element and to create a line of intense heat and explosive energy to sever the mooring line and whereby upon malfunction of said explosive charge said charge housing will continue to move relative to said slider bar member to disengage said studs from said slots and allow said charge housing to rotate about said plunger support pin and permit the mooring line to pull the charge housing from said plunger to completely disengage said charge housing from said slider bar and thus prevent the dragging of the mooring line by said paravane.

14. An improved paravane as set forth in claim 13 and further defined as including;

a second shear pin disposed in said charge housing and extending through said plunger for preventing relative movement between said charge housing and said plunger prior to an application of a predetermined force to said cutting element.

15. An improved paravane as set forth in claim 13 wherein;

an initiator charge is disposed adjacent said explosive charge, a firing pin is slidably disposed within said igniter, a rod means is interlocked with said firing pin for slidable movement therewith and for normally retaining said firing pin a predetermined distance from said initiator charge, said rod means is disposed so as to extend from said igniter, biasing means is provided for urging said firing pin toward said initiator charge, and said rod means is automatically detachable from said firing pin upon a predetermined movement of the rod means from said igniter whereby said firing pin is propelled against said initiator charge by said biasing means to ignite said initiator charge thereby to detonate said explosive charge.

* * * * *